US009534767B2

(12) United States Patent
Rodgers et al.

(10) Patent No.: US 9,534,767 B2
(45) Date of Patent: Jan. 3, 2017

(54) LED LAMP

(71) Applicant: Cree, Inc., Durham, NC (US)

(72) Inventors: Elizabeth Rodgers, Raleigh, NC (US); Heidi Dieringer Loepp, Cary, NC (US); Yaote Huang, Morrisville, NC (US); James Hugh Bowden, Jr., Fuquay-Varina, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/713,163

(22) Filed: May 15, 2015

(65) Prior Publication Data

US 2015/0247625 A1 Sep. 3, 2015

Related U.S. Application Data

(63) Continuation of application No. 13/772,436, filed on Feb. 21, 2013, now Pat. No. 9,062,867.
(Continued)

(51) Int. Cl.
*F21V 19/00* (2006.01)
*F21V 23/02* (2006.01)
(Continued)

(52) U.S. Cl.
CPC ..... *F21V 19/003* (2013.01); *F21K 9/20* (2016.08); *F21K 9/27* (2016.08); *F21S 8/03* (2013.01);
(Continued)

(58) Field of Classification Search
CPC ..... F21V 19/003; F21V 5/048; F21V 7/00; F21V 23/02; F21V 23/06; F21K 9/10; F21K 9/175; F21K 9/20; F21S 8/02; F21S 8/03; F21S 8/04; Y10T 29/49716; F21Y 2101/02; F21Y 2103/003; F21Y 2105/001; F21Y 2103/00; F21Y 2103/10; F21Y 2105/10; F21Y 2115/10; F21Y 2101/00
See application file for complete search history.

(56) References Cited

U.S. PATENT DOCUMENTS 5,463,280 A 10/1995 Johnson
5,585,783 A 12/1996 Hall
(Continued)

FOREIGN PATENT DOCUMENTS

CN 101655189 A 2/2010
EP 1058221 A2 12/2000
(Continued)

OTHER PUBLICATIONS

U.S. Appl. No. 29/467,949, filed Sep. 25, 2013.
(Continued)

*Primary Examiner* — Alan Cariaso
(74) *Attorney, Agent, or Firm* — Dennis J. Williamson; Moore & Van Allen PLLC

(57) ABSTRACT

A lamp comprises a LED lamp comprising a base. A plurality of LEDs are attached to a first side of the base. A lens covers the plurality of LEDs. A power supply provides power to the LEDs. A first electrical connector provides power to the power supply. A troffer housing comprises a wire way for receiving the power supply. A second electrical conductor is adapted to be connected to a source of power. The base is secured to the troffer housing where the power supply is located in the wire way and the first electrical conductor is connected to the second electrical conductor.

21 Claims, 13 Drawing Sheets

Related U.S. Application Data

(60) Provisional application No. 61/736,286, filed on Dec. 12, 2012.

(51) Int. Cl.

| | |
|---|---|
| ***F21S 8/00*** | (2006.01) |
| ***F21V 5/04*** | (2006.01) |
| ***F21V 7/00*** | (2006.01) |
| ***F21V 23/06*** | (2006.01) |
| *F21Y 101/00* | (2016.01) |

(52) U.S. Cl.

CPC ..... *F21V 5/048* (2013.01); *F21V 7/00* (2013.01); *F21V 23/02* (2013.01); *F21V 23/06* (2013.01); *F21Y 2101/00* (2013.01); *F21Y 2103/10* (2016.08); *F21Y 2105/10* (2016.08); *F21Y 2115/10* (2016.08); *Y10T 29/49716* (2015.01)

(56) References Cited

U.S. PATENT DOCUMENTS

| | | | | |
|---|---|---|---|---|
| 5,655,830 | A | 8/1997 | Ruskouski | |
| 5,688,042 | A | 11/1997 | Madadi et al. | |
| 5,947,588 | A | 9/1999 | Huang | |
| 5,949,347 | A | 9/1999 | Wu | |
| 5,952,916 | A | 9/1999 | Yamabe | |
| 6,220,722 | B1 | 4/2001 | Begemann | |
| 6,276,822 | B1 | 8/2001 | Bedrosian et al. | |
| 6,452,217 | B1 | 9/2002 | Wojnarowski et al. | |
| 6,465,961 | B1 | 10/2002 | Cao | |
| 6,634,770 | B2 | 10/2003 | Cao | |
| 6,635,987 | B1 | 10/2003 | Wojnarowski et al. | |
| 6,639,360 | B2 | 10/2003 | Roberts et al. | |
| 6,739,734 | B1 * | 5/2004 | Hulgan | F21S 8/02 362/217.05 |
| 6,746,885 | B2 | 6/2004 | Cao | |
| 6,853,151 | B2 | 2/2005 | Leong et al. | |
| 6,860,628 | B2 | 3/2005 | Robertson et al. | |
| 6,936,968 | B2 | 8/2005 | Cross et al. | |
| 7,048,410 | B2 | 5/2006 | Kutler | |
| 7,049,761 | B2 | 5/2006 | Timmermans et al. | |
| 7,114,830 | B2 | 10/2006 | Robertson et al. | |
| 7,195,372 | B2 * | 3/2007 | Plunk | B24D 15/00 362/221 |
| 7,307,391 | B2 | 12/2007 | Shan | |
| 7,510,299 | B2 | 3/2009 | Timmermans et al. | |
| 7,815,338 | B2 | 10/2010 | Siemiet et al. | |
| 7,926,975 | B2 | 4/2011 | Siemiet et al. | |
| 7,976,196 | B2 | 7/2011 | Ivey et al. | |
| 8,058,659 | B2 | 11/2011 | Bisberg | |
| 8,061,867 | B2 * | 11/2011 | Kim | F21S 8/026 362/217.01 |
| 8,093,823 | B1 | 1/2012 | Ivey et al. | |
| 8,115,411 | B2 | 2/2012 | Shan | |
| 8,118,447 | B2 | 2/2012 | Simon et al. | |
| 8,247,985 | B2 | 8/2012 | Timmermans et al. | |
| 8,272,763 | B1 * | 9/2012 | Chinnam | F21V 29/004 362/147 |
| 8,282,247 | B2 | 10/2012 | Ivey et al. | |
| 8,324,817 | B2 | 12/2012 | Ivey et al. | |
| 8,360,599 | B2 | 1/2013 | Ivey et al. | |
| 8,362,710 | B2 | 1/2013 | Langovsky | |
| 8,376,583 | B2 * | 2/2013 | Wang | F21V 17/002 362/249.02 |
| 8,382,327 | B2 | 2/2013 | Timmermans et al. | |
| 8,408,743 | B1 | 4/2013 | Chen et al. | |
| 8,419,223 | B2 | 4/2013 | Withers | |
| 8,421,366 | B2 | 4/2013 | Palazzolo et al. | |
| 8,449,137 | B2 | 5/2013 | Dassanayake et al. | |
| 8,482,212 | B1 | 7/2013 | Ivey et al. | |
| 8,523,383 | B1 * | 9/2013 | Grigore | F21S 8/026 362/217.13 |
| 8,573,813 | B2 | 11/2013 | Ivey et al. | |
| 8,596,813 | B2 | 12/2013 | Ivey | |
| 8,613,525 | B2 | 12/2013 | Shimizu et al. | |
| 8,643,043 | B2 * | 2/2014 | Shimizu | F21S 4/008 257/88 |
| 2002/0060526 | A1 | 5/2002 | Timmermans et al. | |
| 2004/0201990 | A1 | 10/2004 | Meyer | |
| 2008/0266849 | A1 * | 10/2008 | Nielson | F21V 23/026 362/221 |
| 2009/0140271 | A1 | 6/2009 | Sah | |
| 2009/0184618 | A1 | 7/2009 | Hakata et al. | |
| 2012/0040585 | A1 | 2/2012 | Huang | |
| 2012/0051041 | A1 | 3/2012 | Edmond et al. | |
| 2012/0155073 | A1 * | 6/2012 | McCanless | F21S 8/04 362/218 |
| 2014/0043804 | A1 | 2/2014 | Negley et al. | |

FOREIGN PATENT DOCUMENTS

| | | | |
|---|---|---|---|
| EP | 1475846 | A2 | 11/2004 |
| GB | 2345954 | A | 7/2000 |
| JP | H08162677 | A | 6/1996 |
| JP | H09265807 | A | 10/1997 |
| JP | 2000173304 | A | 6/2000 |
| JP | 2001118403 | A | 4/2001 |
| WO | 9833007 | | 7/1998 |
| WO | 0124583 | A1 | 4/2001 |
| WO | 0160119 | A2 | 8/2001 |
| WO | 2004100213 | A2 | 11/2004 |
| WO | 2010099755 | A1 | 9/2010 |
| WO | 2012011279 | A1 | 1/2012 |
| WO | 2012031533 | A1 | 3/2012 |

OTHER PUBLICATIONS

U.S. Appl. No. 13/943,152, filed Jul. 16, 2013.

LIQUILEDS, Liquid LED, http://www.liquidleds.com.tw/, Sep. 28, 2010, 1 page.

Cree, Inc., International Application No. PCT/US2011/062795, International Search Report and Written Opinion, Jun. 1, 2012.

U.S. Appl. No. 13/943,376, filed Jul. 16, 2013.

U.S. Appl. No. 13/943,455, filed Jul. 16, 2013.

U.S. Appl. No. 14/103,063, filed Dec. 11, 2013.

U.S. Appl. No. 14/224,501, filed Mar. 25, 2014.

* cited by examiner

LED LAMP

This application is a continuation of U.S. application Ser. No. 13/772,436, filed on Feb. 21, 2013, now U.S. Pat. No. 9,062,867, which claims benefit of priority under 35 U.S.C. §119(e) to the filing date of U.S. Provisional Application No. 61/736,286, as filed on Dec. 12, 2012, both of which are incorporated herein by reference in their entirety.

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

SUMMARY OF THE INVENTION

In one embodiment, a lamp comprises a LED lamp comprising a base. A plurality of LEDs are attached to a first side of the base. A lens covers the plurality of LEDs. A power supply provides power to the LEDs. A first electrical connector provides power to the power supply. A troffer housing comprises a wire way for receiving the power supply. A second electrical conductor is adapted to be connected to a source of power. The base is secured to the troffer housing where the power supply is located in the wire way and the first electrical conductor is connected to the second electrical conductor.

The lamp may comprise a ballast located in the wire way. The base may be a substantially planar member. The base may be dimensioned to cover the wire way. The base may comprise a tab that engages a mating aperture on the troffer housing. The base may comprise a snap-fit connector that secures the base to the troffer housing. The snap-fit connector may comprise a deformable member. The plurality of LEDs may extend for substantially the length of the base. The plurality of LEDs may be removable from the base. A portion of the base may be reflective. The power supply may be mounted on a back side of the base. The lens may diffuse and mix light from the plurality of LEDs. The lens may have a semicircular cross-sectional shape. The lens may be connected to the base. The lens may be connected to the base using a snap-fit connection. The LEDs may be at approximately the same distance from the surface of the lens over the entire surface area of the lens.

In one embodiment, a LED lamp comprises a base. A plurality of LEDs are attached to a first side of the base. A lens covers the plurality of LEDs. A power supply provides power to the LEDs. A first electrical connector provides power to the power supply. A first connector on one end of the base is adapted to connect the base to a troffer housing.

The power supply may be attached to a second side of the base. The base may be a substantially planar member. The base may be dimensioned to cover a wire way in the troffer housing. The base may comprise a tab that is adapted to engage a mating aperture on the troffer housing. The first connector may be a snap-fit connector. The snap-fit connector may comprise a deformable member. The plurality of LEDs may extend for substantially the length of the base.

In one embodiment, a method of assembling a LED fixture comprises removing a fluorescent tube from a housing; removing a wire way cover from the housing; disconnecting a first electrical conductor between a source of AC power and the fluorescent tube; positioning an LED lamp comprising a base and a plurality of LEDs in the troffer housing; electrically coupling a second electrical connector from the LED lamp to the first electrical conductor; and securing the base to the housing.

The step of disconnecting may comprise disconnecting the first electrical conductor to a ballast for the fluorescent light and leaving the ballast in the fixture housing. The method may further comprise removing a tombstone connector from the housing. The LED electronics may be positioned in a wire way of the housing. The method may comprise inserting a tab on the base into a slot on the housing. The method may comprise suspending the LED lamp from the housing using a tether during the step of electrically coupling. The step of securing the base to the housing may comprise engaging a snap-fit connector. The method of assembling may be performed with the housing attached to a ceiling.

DETAILED DESCRIPTION

Figure 1:
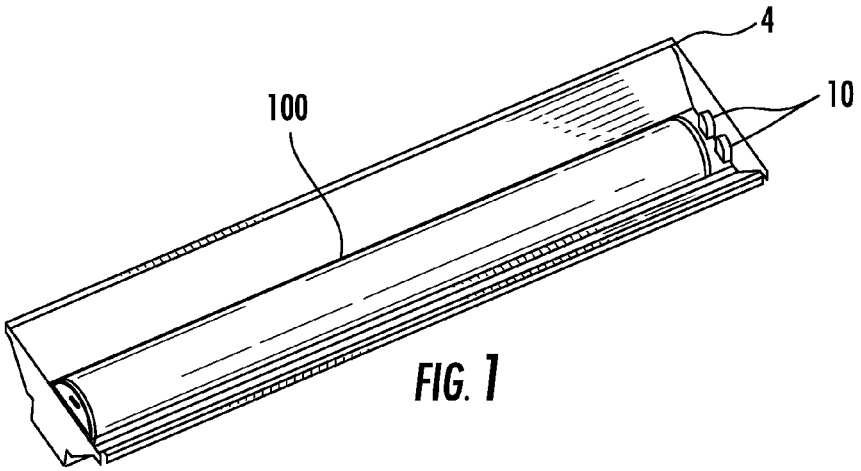
FIGS. 1 through 3 are perspective views showing an embodiment of a fixture with a troffer housing and LED lamp.
Figure 2:
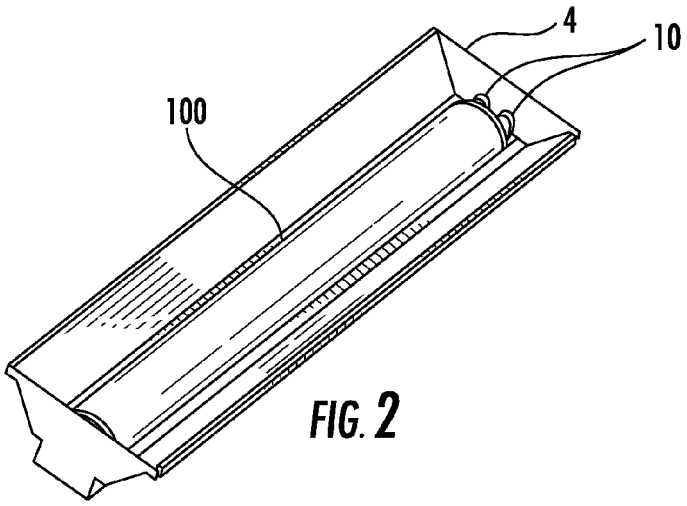
Figure 3:
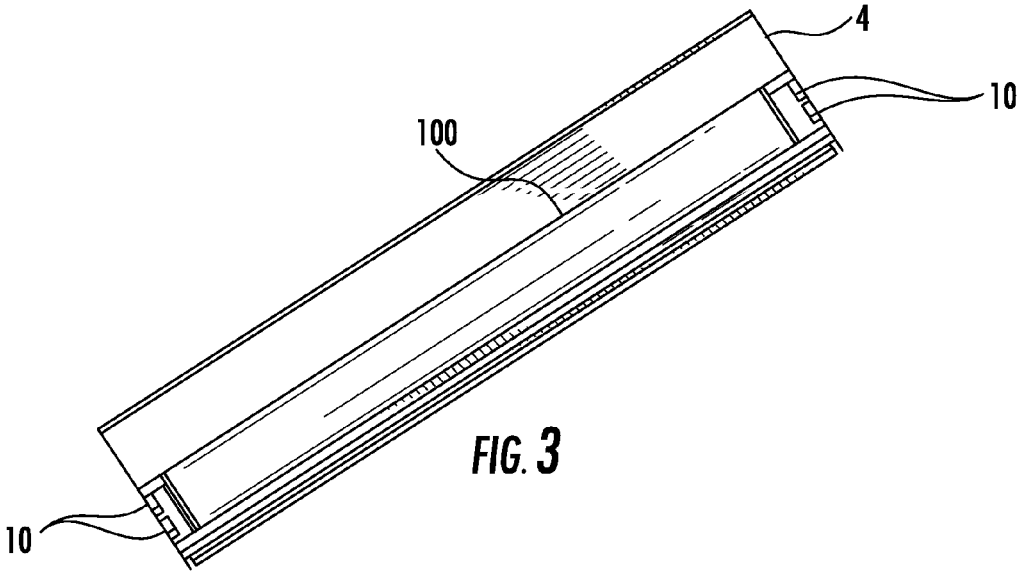
Figure 4:
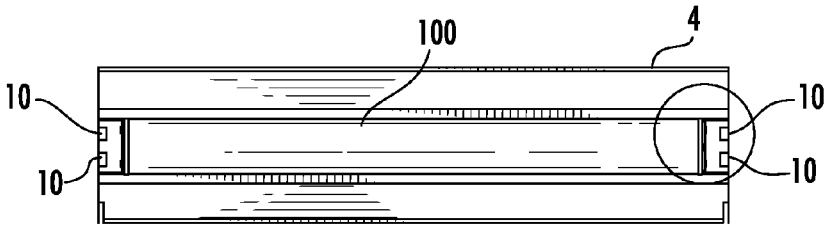
FIG. 4 is a bottom view of the fixture of FIG. 1.
Figure 5:
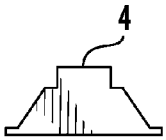
FIG. 5 is a left side view of the fixture of FIG. 1.
Figure 6:
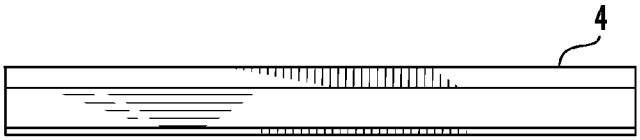
FIG. 6 is a front view of the fixture of FIG. 1.
Figure 7:
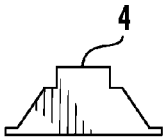
FIG. 7 is a right side view of the fixture of FIG. 1.
Figure 8:
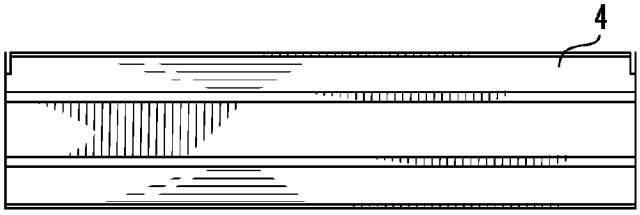
FIG. 8 is a top view of the fixture of FIG. 1.
Figure 9:
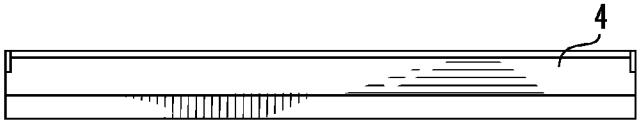
FIG. 9 is a back view of the fixture and lamp of FIG. 1.
Figure 10:
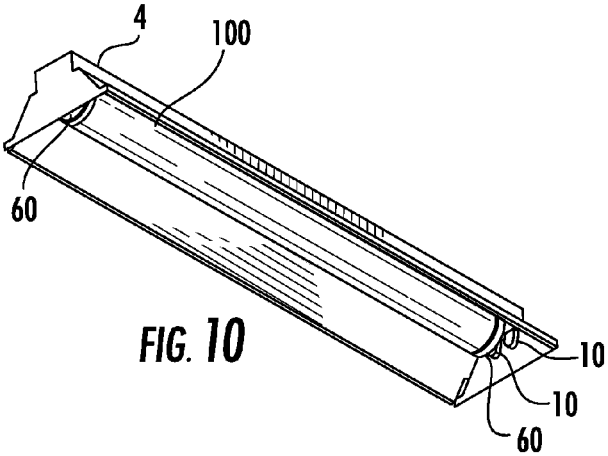
FIG. 10 is another perspective view of the fixture and lamp of FIG. 1.
Figure 11:
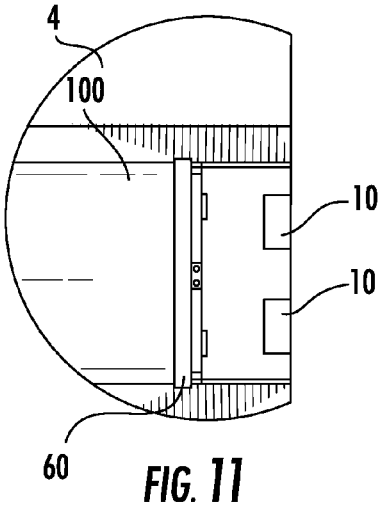
FIG. 11 is a detailed view of the fixture and lamp of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 12:
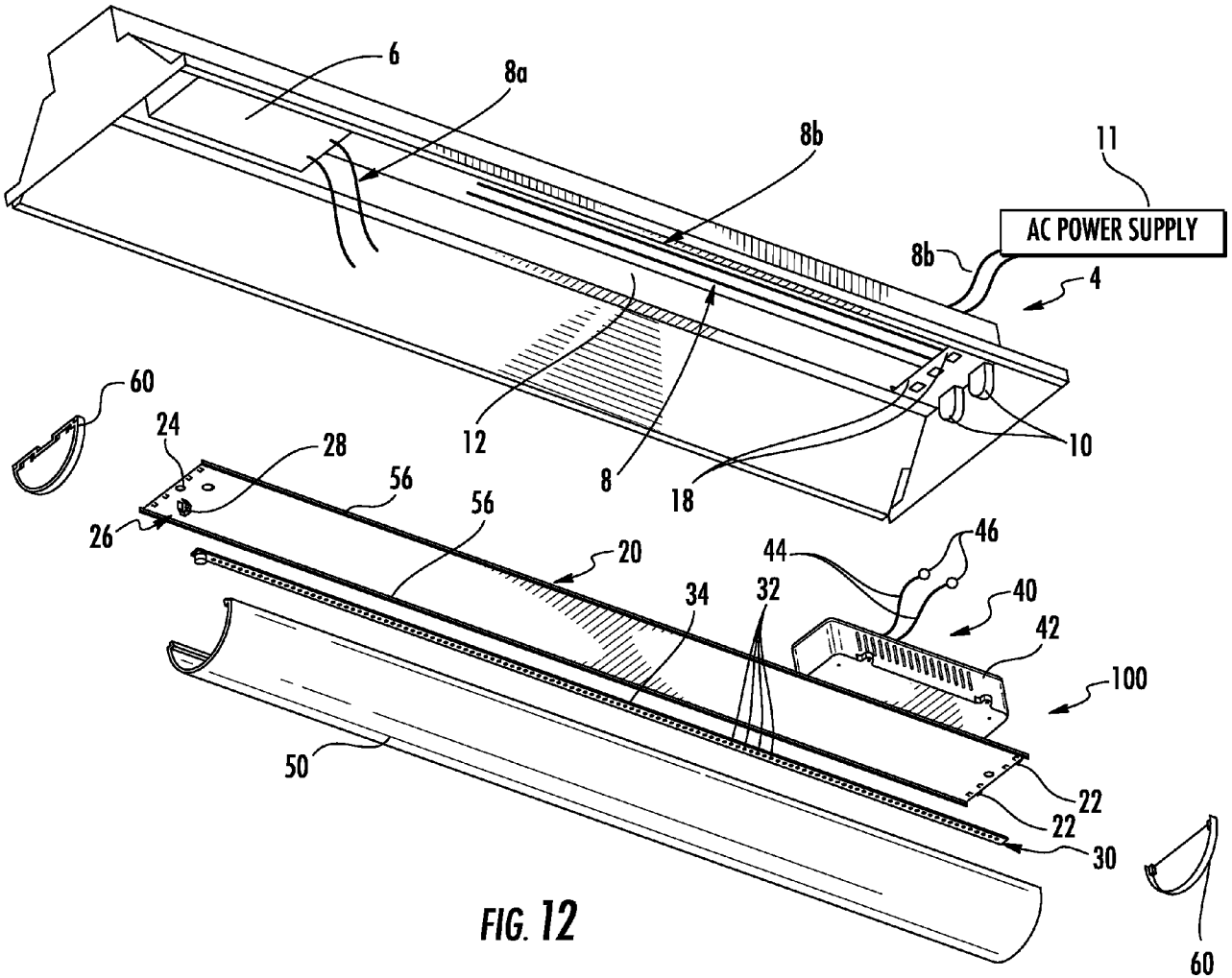
FIG. 12 is an exploded perspective view of the lamp of FIG. 1.
Figure 13:
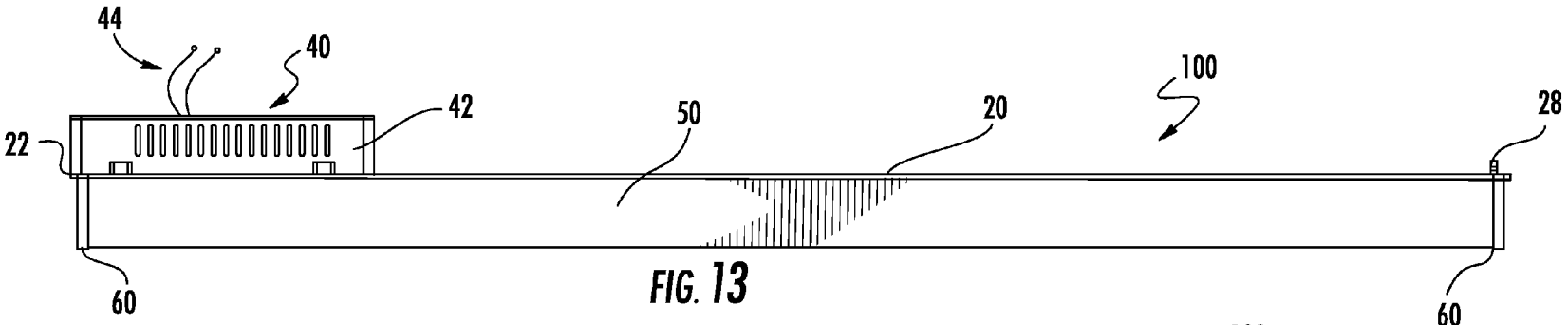
FIGS. 13 through 15 are front, top, and bottom views of an embodiment of the LED lamp.
Figure 14:
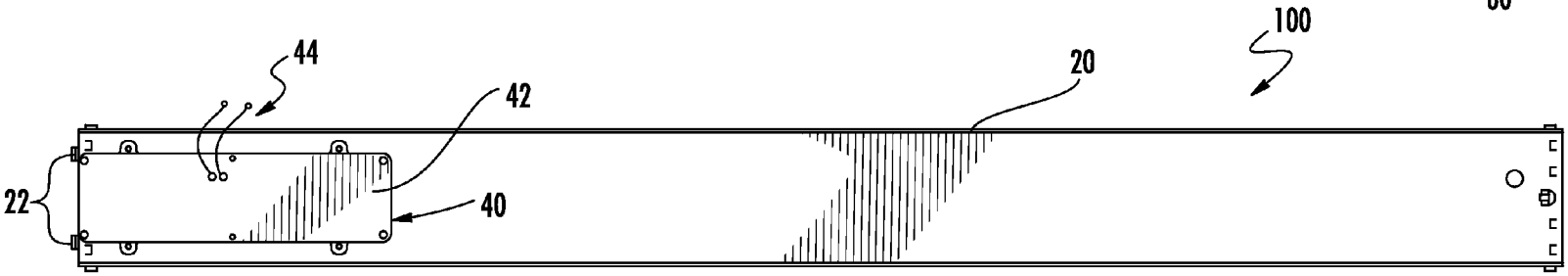
Figure 15:
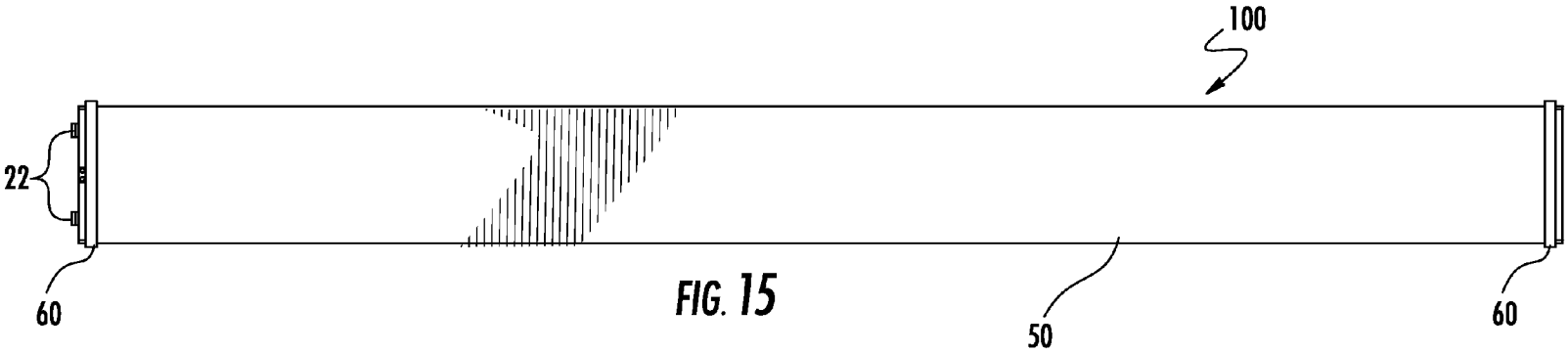
Figure 16:
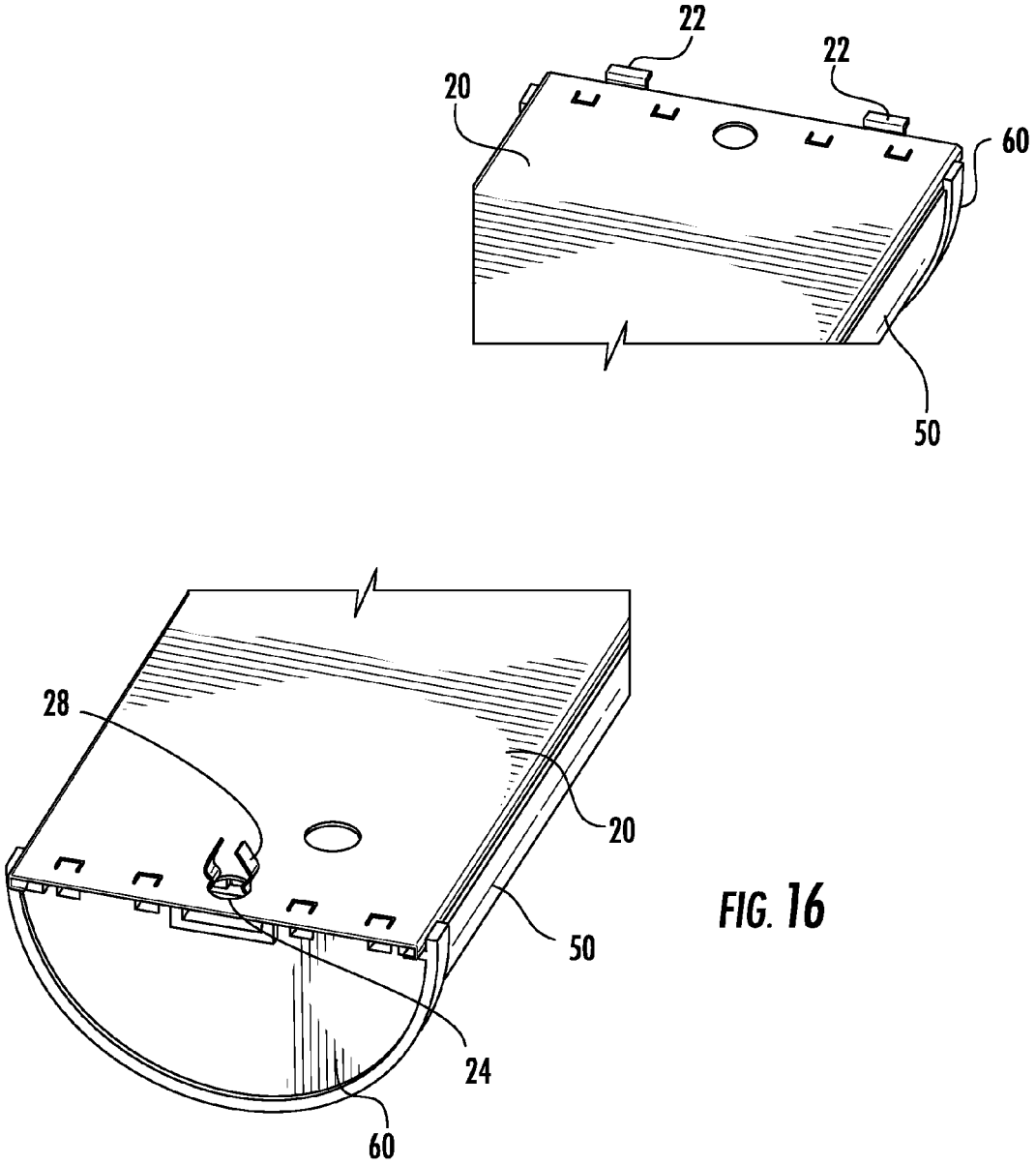
FIG. 16 is a partial perspective view of the LED lamp of FIGS. 13 through 15.
Figure 17:
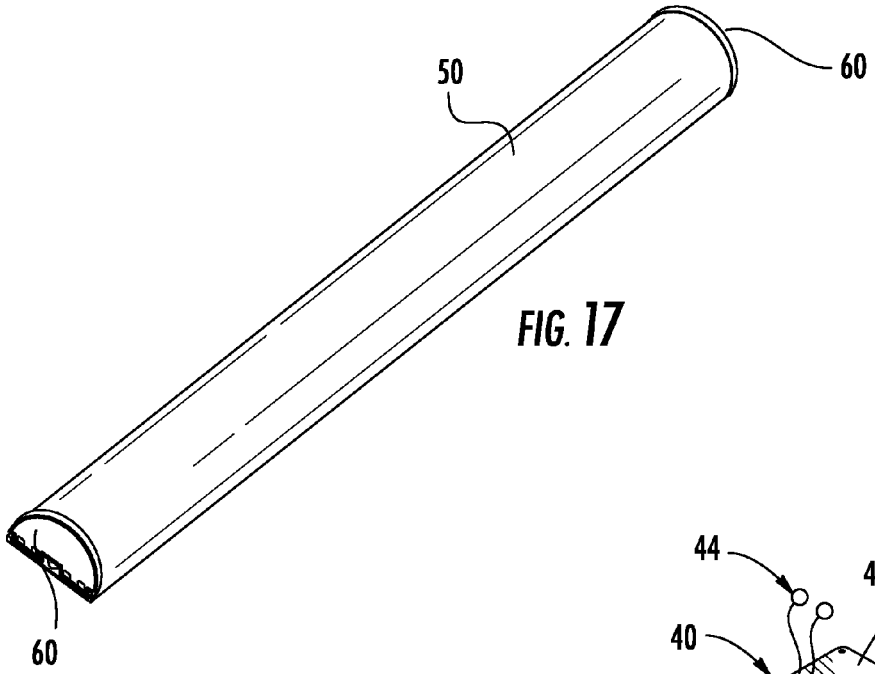
FIGS. 17 and 18 are bottom and top perspective views of the LED lamp of FIGS. 13 through 16.
Figure 18:
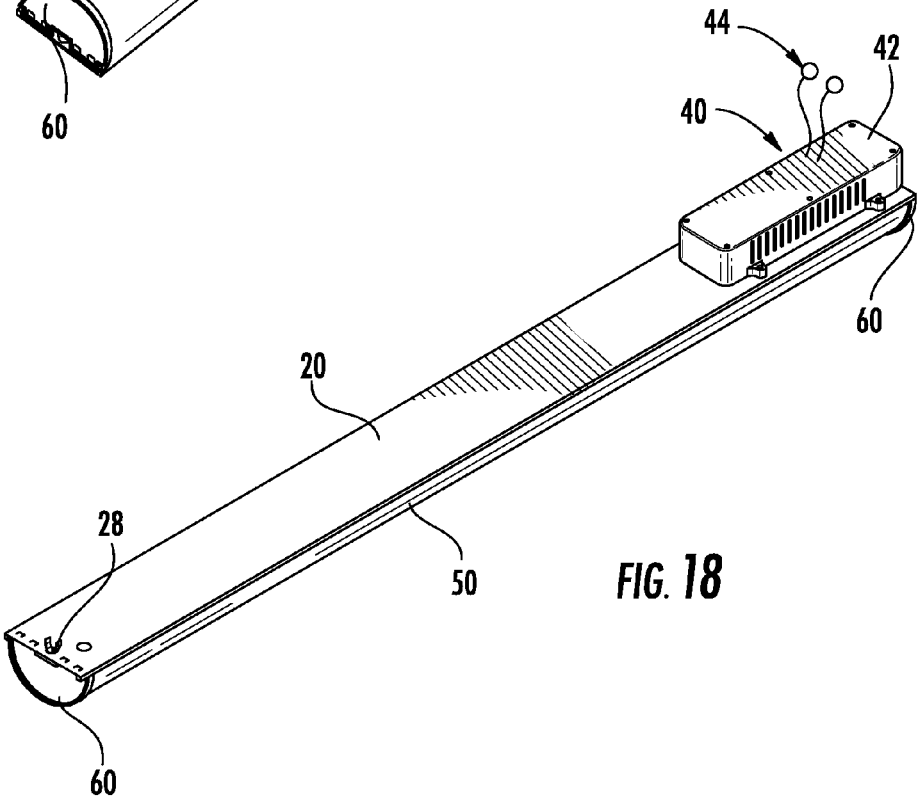
Figure 40A:
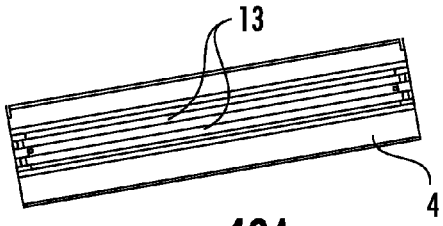
FIGS. 40*a*-40*h* show a method of assembling a troffer fixture using the LED lamp.
Figure 40E:
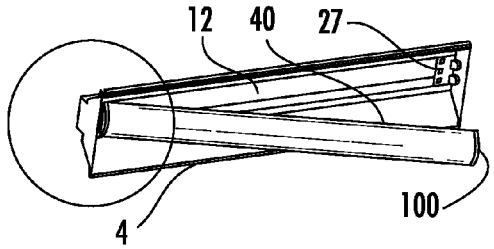
Figure 40B:
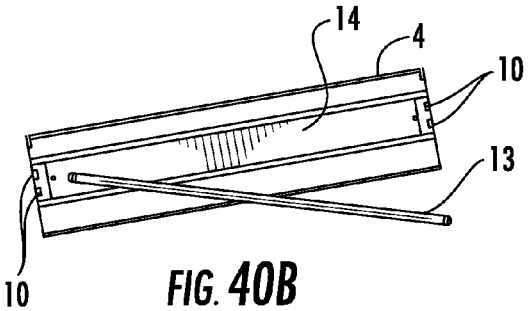

Shown in FIGS. 40*a* and 40*b* is one embodiment of a traditional fluorescent troffer fixture having a housing 4 that may be recess mounted or flush mounted in a ceiling or other support. While one embodiment of a troffer housing 4 is shown, the troffer housing may comprise a variety of shapes sizes and configurations. In a retrofit application, the troffer housing 4 typically supports the ballast 6 and electrical conductors 8 such as wiring that comprise the electrical connection between the lamp's tombstone connectors 10 and an AC power supply 11 (see FIG. 12). The AC power supply 11 may be the electrical grid of a building or other structure or the like. The tombstone connectors 10 connect to the pins formed on the opposite ends of a fluorescent tube 13 to provide power to the fluorescent tube. Typically, the ballast 6, wiring 8 and other electrical components are retained in a compartment or wire way 12 at the bottom of the housing 4. The wire way 12 typically comprises a recessed area or trough in the base of the housing 4. The wire way 12 may extend for substantially the entire length of the housing 4. The wire way 12 is typically covered by a removable wire way cover 14 (see FIGS. 40*a*-40*d*) such that the only exposed electrical components are the UL approved tombstone connectors 10. As shown in FIGS. 36-39, the typical wire way cover 14 includes one or more tabs 15 that extend from one end of the cover 14 and that may be inserted into mating apertures 18 formed in the bottom of the troffer housing 4. The tabs 15 are inserted into the apertures 18 and the cover 14 is placed against the bottom of the troffer housing 4 to cover the wire way 12. The opposite end of the wire way cover 14 is fixed to the bottom of the troffer housing 4 by a fastener such as a clip or threaded screw that engages a hole 19 formed on the cover 14 and threadably engages a hole formed on the troffer housing 4.

Because LED based solid state lamps use less energy, are more durable, operate longer, can be combined in multicolor arrays that can be controlled to deliver virtually any color light, and generally contain no lead or mercury the conversion to, or replacement of fluorescent lighting systems with, LED lighting systems is desired. In some existing replacement lamps the entire fluorescent fixture including the troffer must be replaced. In other systems the troffer and electrical system must be greatly modified to accommodate an LED based system. In either circumstance the conversion from a fluorescent light to a solid state LED based light may be time consuming and expensive. In the system of the invention, a traditional fluorescent troffer light may be converted to an LED based solid state lamp quickly and easily. The LED troffer light of the invention allows a traditional fluorescent troffer light to be converted to a solid state LED lamp without requiring specialized tools, equipment or training. The conversion may be accomplished using maintenance personnel and requires the same skills as replacing a light fixture.

The LED replacement lamp 100, FIGS. 12-18, comprises a generally planar or flat base 20 having a length and width that are substantially greater than the thickness of the base. In one embodiment the base 20 may be approximately 4 inches wide, 45 inches long and 0.16 inches thick. In some embodiments, the base 20 has approximately the same overall dimensions as the traditional wire way cover 14 such that the base 20 covers the wire way 12 to isolate the electrical components of the lamp from the external environment. While the base 20 is described as having approximately the same dimensions as the wire way cover 14 the base 20 may have other shapes and dimensions provided it covers the electrical components of the lamp.

The ends of the base 20 may be provided with the same connection mechanism that connects the wire way cover 14 to the housing in the fluorescent light fixture that is being retrofit. In the illustrated embodiment, the base 20 is formed with tabs 22 that engage the mating apertures 18 formed on the base of the troffer housing 4 in the same manner as the tabs 15 of wire way cover 14. The opposite end of the base 20 may be provided with an aperture 24 for receiving a connector such as a screw as previously described; however, in some embodiments the LED fixture is provided with a snap-fit connector 26 that engages an aperture 27 in the troffer housing 4 using a snap-fit connection such that the base 20 may be attached to the troffer housing 4 using no tools or separate fasteners. The snap-fit connector 26 may be provided by a deformable member 28 that extends through aperture 24 and is press fit into the hole in the troffer housing 4 and elastically deforms to engage the troffer housing and retain the base 20 on the troffer housing 4. The deformable member 28 may be an S-spring or other similar resilient plastic or metal member. The connector 26 may also be spring biased rather than being deformable. The connector 26 may also be made using a manually operated latch that engages the troffer housing 4. In some embodiments, the connector 26 may be releasable such that the LED fixture may be removed from the troffer housing 4 and replaced; however, more permanent attachment mechanisms such as welding, adhesive or the like may also be used. Use of a deformable snap-fit connector may provide the simplest installation of the LED fixture.

The LED lamp 100 comprises an LED array 30 that may be supported by and secured to the base 20. The LED array 30 may comprise a plurality of LEDs or LED packages 32 that extend the length of, or substantially the length of, the base 20 to create a desired light pattern. The LEDs 32 may be arranged such that the light pattern extends the length of, or for a substantial portion of the length of, the troffer fixture and is similar in length to a traditional fluorescent bulb. While in one embodiment the LEDs extend for substantially the entire length of the base, the LEDs may be arranged in other patterns and may extend for less than substantially the entire length of the base if desired. The LEDs 32 may be mounted on a substrate 34 that provides physical support for the LEDs 32 and provides an electrical path for providing electrical power to the LEDs. The LEDs 32 may be provided on the base in a wide variety of patterns and may include a wide variety of different types and colors of LEDs to produce light in a wide variety of colors and/or light patterns. One embodiment of a troffer LED lamp and suitable LED structure is shown and described in U.S. patent application Ser. No. 12/873,303 entitled "Troffer-Style Fixture" filed on Aug. 31, 2010, which is incorporated by reference herein in its entirety. The LED array 30 may be made removable from the base 20 for maintenance purposes or to change the light output for various applications. The LED array 30 may be made removable by attaching the substrate 34 to the base 20 using a releasable connection mechanism such as, but not limited to, a snap-fit connection, screws or other releasable fasteners, friction fit, or the like. The LED assembly 30 may be removed and replaced with a different type of LED assembly depending on the application and use of the lamp such as to provide different types, colors or intensities of light. A releasable electrical connector may be provided between the removable LED array and the lamp electronics 40. The base 20 and LED array 30 may be made of a reflective material, e.g., MCPET, white optic, or the like, to reflect light from the mixing chamber. The reflective material may also be applied to the base 20 and substrate and/or LED array with "cutouts" provided to expose the LEDs. The entire base may be made of a reflective material or portions of the base may be made of reflective material. For example, portions of the base that may reflect light may be made of reflective material.

The power supply, drivers, other electrical circuitry and electrical connectors 40 for powering the LEDs of the LED array 30 may be mounted to the back side of the base 20. These components may be contained in a housing 42 to isolate the components from the external environment. The housing 42 is dimensioned to fit into the wire way 12 of the troffer housing 4 of the fixture being retrofit. The power supply comprises electrical connectors 44 for connecting the power supply, driver and other components to the AC power supply. In one embodiment the connectors 44 comprise wires that may connected to the existing AC power supply wires 8. The wires 44 may terminate in electrical connectors 46 or separate electrical connectors may be used to connect the electronics of the LED fixture to the AC power supply 11. The lamp electronics 40 are connected to LEDs 32 to provide an electrical connection between the AC power supply and the LEDs.

A lens 50 may be connected to the base 20 to cover the LED array 30 and create a mixing chamber for the light emitted from the LEDs 32. The lens 50 diffuses and mixes the light from the LEDs 32 to provide as uniform, diffuse, color mixed light pattern. The lens 50 may be made of molded plastic or other material and may be provided with a light diffusing layer. The light diffusing layer may be provided by etching, application of a coating or film, by the translucent or semitransparent material of the lens, by forming an irregular surface pattern during formation of the lens or by other methods.

Figure 20:
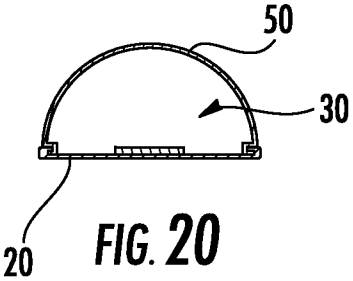
FIG. 20 is a section view taken along line 20-20 of FIG. 20.
Figure 19:
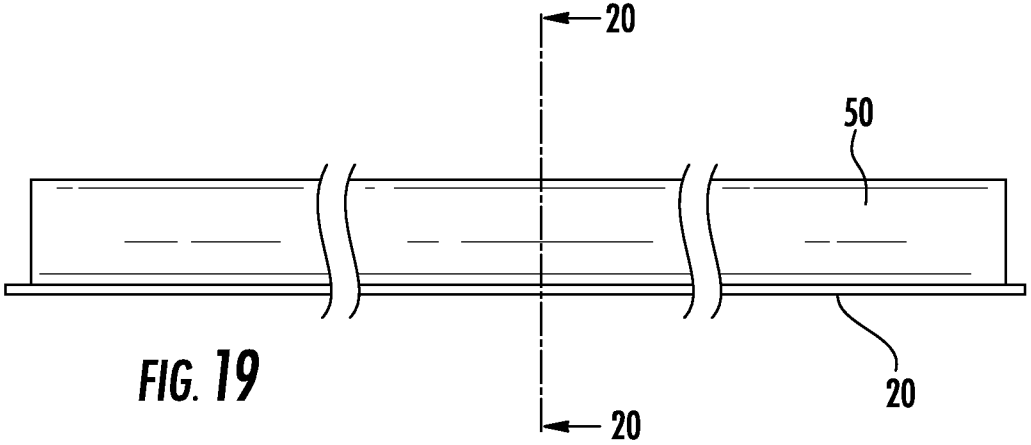
FIG. 19 is a partial side view of an assembly for the LED lamp.
Figure 21:
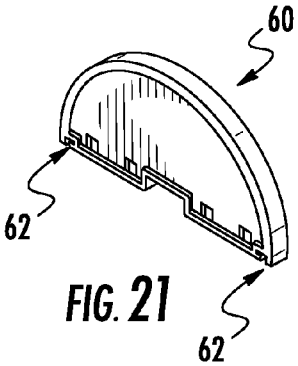
FIG. 21 is a front perspective view of the end caps used in the LED lamp.
Figure 22:
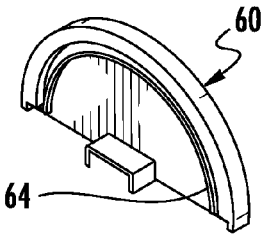
FIG. 22 is a back perspective view of the end caps used in the LED lamp.
Figure 23:
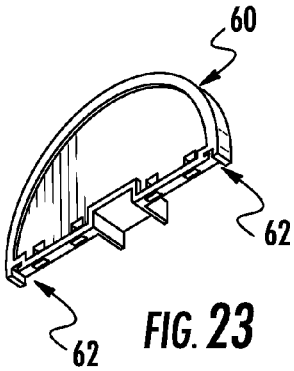
FIG. 23 is another front perspective view of the end caps used in the LED lamp.
Figure 24:
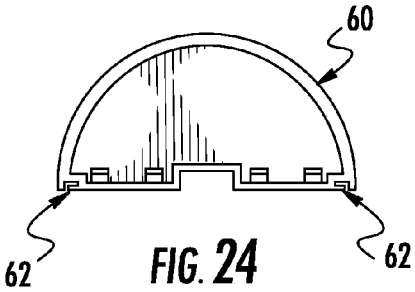
FIG. 24 is a front view of the end caps used in the LED lamp.
Figure 26:
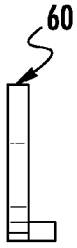
FIG. 26 is a side view of the end caps used in the LED lamp.
Figure 25:
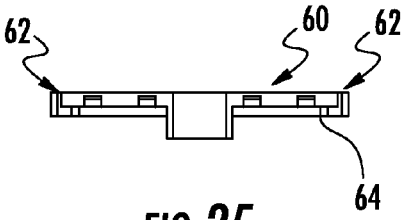
FIG. 25 is a bottom view of the end caps used in the LED lamp.
Figure 27:
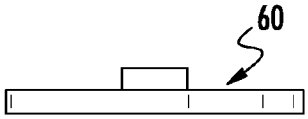
FIG. 27 is a top view of the end caps used in the LED lamp.
Figure 29:
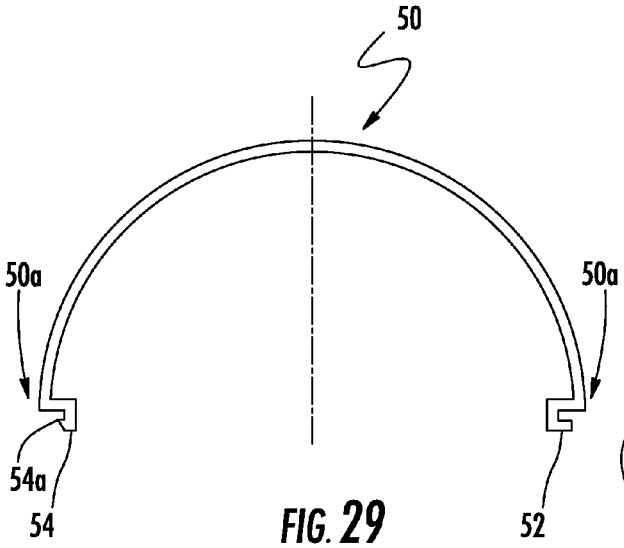
FIG. 29 is an end view of an embodiment of a lens usable in the LED lamp.
Figure 31:
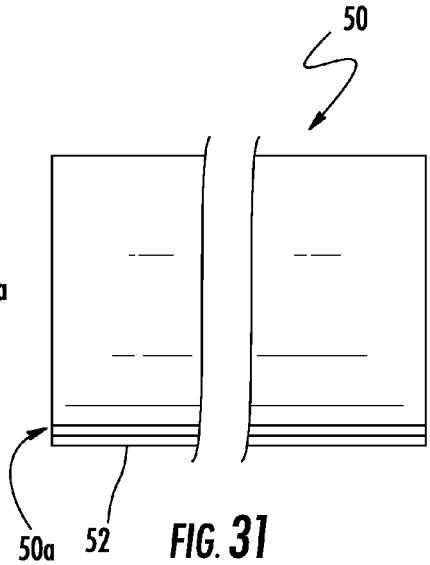
FIG. 31 is a side view of the lens of FIG. 23.
Figure 32:
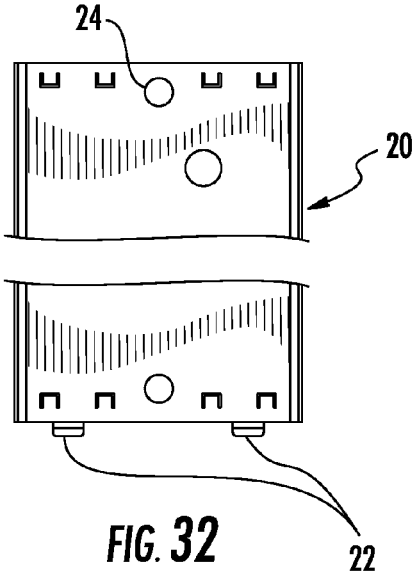
FIG. 32 is a top view of the base usable in the LED lamp.
Figure 33:
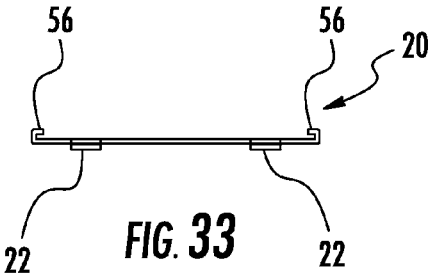
FIG. 33 is an end view of the base of FIG. 26.
Figure 34:
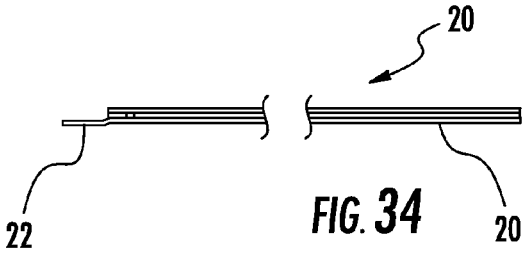
FIG. 34 is a side view of the base of FIG. 26.
Figure 35:
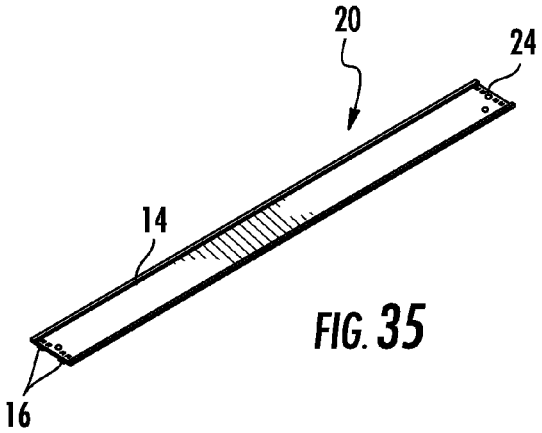
FIG. 35 is a perspective view of the base of FIG. 26.
Figure 36:
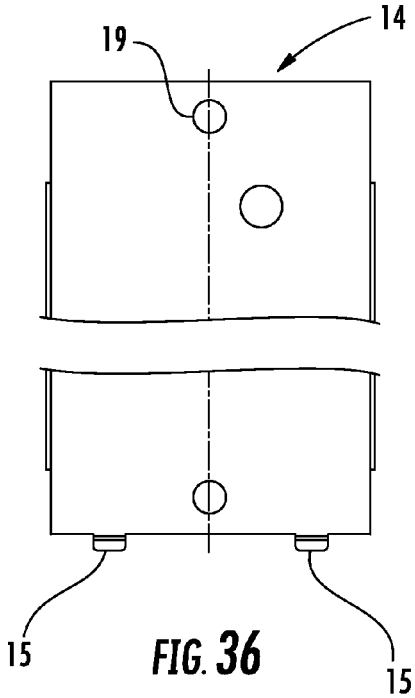
FIG. 36 RELATED ART
FIGS. 36-39 are various views of a related art wire way cover.
Figure 37:
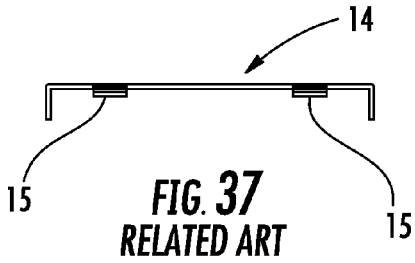
FIG. 37 RELATED ART
Figure 38:
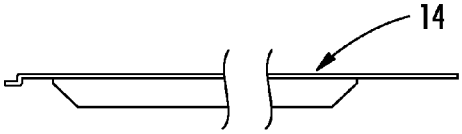
FIG. 38 RELATED ART
Figure 39:
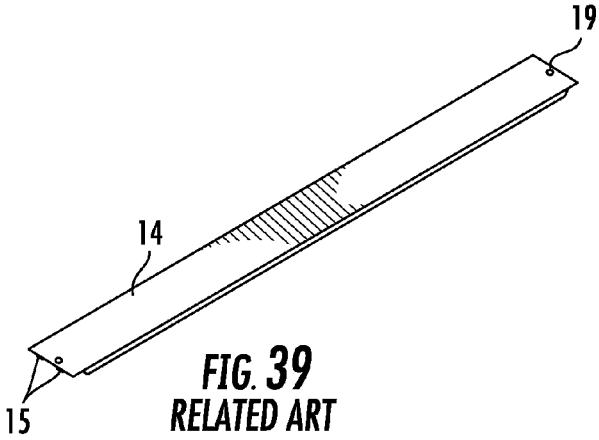
FIG. 39 RELATED ART

In some embodiments the lens 50 has a semicircular cross-sectional shape as shown for example in FIGS. 20 and 29. The lens 50 extends the length of the base 20 to cover the LEDs 32 supported on the base 20. In some embodiments, the longitudinal edges 50*a* of the lens 50 are provided with undercut areas that define lips or projections 52 and 54 that may be received in longitudinal channels 56 formed along the longitudinal edges of the base 20. The lens 50 and projections 52, 54 may be formed as one piece such as by a plastic molding process. In some embodiments, the base 20 may be formed of stamped or rolled metal where the channels 56 are formed as one-piece with the base; however, the channels may be separately attached to the base. The projections 52, 54 are inserted into the channels 56 to retain the lens 50 on the base 20. The projections 52, 54 may be slid into the channels 56 from the end of the base 20. If the lens 50 is made of an elastic material, such as molded plastic, the projections 52, 54 may also be inserted into the channels 56 by inserting a first projection 52 into one of the channels and deforming the lens to insert the opposite projection 54 into the opposite channel. The lens 50 may then be released such that the lens elastically returns to its original shape where the projections 52, 54 are forced into the opposed channels 56. The second projection 54 may be formed with an angled face 54*a* that acts as a camming surface to facilitate the deformation of the lens as it is inserted into the base. With such a structure the first projection 52 may be inserted into one of the channels 56 and the camming surface 54*a* of the second projection 54 may be pressed against the upper surface edge of the opposite channel to deform the lens 50 and create a snap-fit connection between the lens 50 and the base 20.

Figure 28:
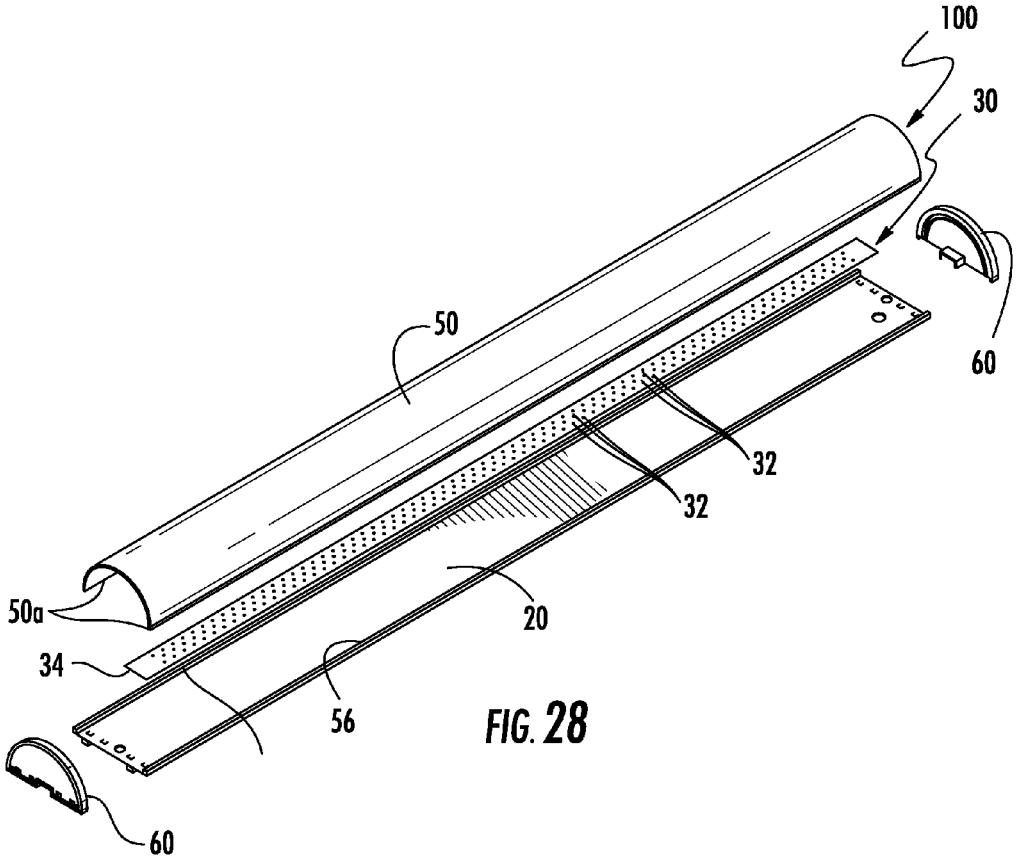
FIG. 28 is an exploded view of the LED lamp.
Figure 30:
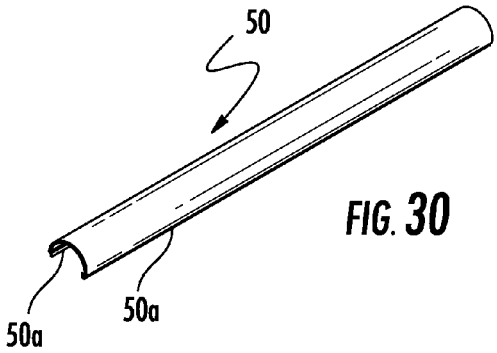
FIG. 30 is a perspective view of the lens of FIG. 23.

In one embodiment, the lens 50 is semicircular when viewed from the end or at any perpendicular cross-section. As a result, where the LEDs 32 are disposed generally along the longitudinal center line of the base 20 (FIG. 12), all of the LEDs 32 are at approximately the same distance from the surface of the lens 50 over the entire surface area of the lens. Because all of the LEDs are disposed the same distance from the lens over the entire surface of the lens, the development of visible bright spots or color spots is prevented and a uniform color and intensity light distribution is created. While LEDs 32 arranged along the exact longitudinal center-line of the base 20 are disposed the same distance from the surface of the lens 50 over the entire surface area of the lens, small deviations from this arrangement may be made without creating bright spots. For example, the LEDs 32 may be staggered about the longitudinal center-line of the base 20 (FIG. 28) such that there are small differences in the distance of the LEDs to the surface of the lens; however, the small differences are negligible and not visible during normal use of the light.

End caps 60 (FIGS. 21-27) may be provided at the opposite ends of the lens 50 to close the interior mixing chamber of LED lamp 100. The end caps 60 may be made of a reflective material such as white plastic to reflect light back into the light mixing chamber and out of the lens 50. The end caps 60 may be connected to the base 20 and/or to the lens 50 using cut-outs 62 that may be slid into engagement with the channels 56 formed on the base 20. The end caps 60 may also be provided with a groove 64 for receiving the end of the lens 50. The end caps 60, base 20 and lens 50 may be connected to one another using other mechanisms such as adhesive, mechanical connectors, welding, friction fit or the like.

To retrofit an existing fluorescent fixture (FIG. 40*a*), the existing fluorescent tubes 13 are removed from the fixture housing (FIG. 40*b*). The clip or other fastener holding one end of the wire way cover 14 is removed from the housing 4 (FIG. 40*c*). The wire way cover 14 is removed and the electrical conductors 8 that run from the power source to the ballast 6 for the fluorescent lights are disconnected (FIG. 40*d*). In a typical installation these conductors may comprise wires that may simply be cut to create a wire portion 8*a* that is disconnected and the runs to the ballast and a wire portion 8*b* that is connected to the power supply 11. The LED lamp 100 is dimensioned to fit between the tombstone connectors 10 such that the connectors may be left in place. Alternatively, the tombstone connectors 10 may be removed. If the connectors 10 are removed snap-fit covers may be provided to fill in the apertures in housing 4 in which the connectors were located. However, because the power connection to the tombstone connectors 10, ballast 6 and other electronics of the fluorescent light is cut, these elements may be left in place in the housing.

The LED lamp 100 is located in the troffer housing 4 such that the LED electronics 40 fit into the wire way 12 of the troffer housing 4 (FIG. 40*e*). In a typical fluorescent light the ballast 6 and other electronics are typically located at one end of the wire way 12. In the LED lamp 100 of the invention the electronics 40 and housing 42 may be located at one end of the base 20 such that the base 20 may be oriented in the troffer housing 4 with the LED electronics 40 positioned at either end of the wire way 12 to the side opposite the fluorescent light ballast 6 and electronics. While the LED electronics 40 are shown as being physically attached to the base, the electronics may be electrically coupled to the base but physically separate.

Figure 40F:
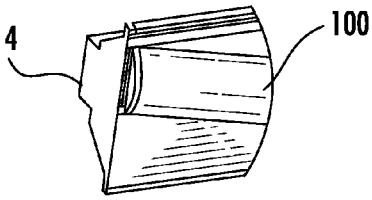
Figure 40C:
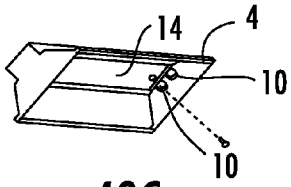
Figure 40G:
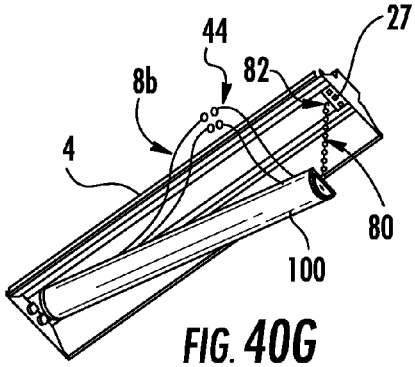
Figure 40D:
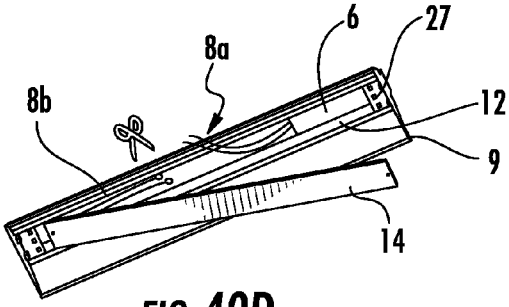
Figure 40H:
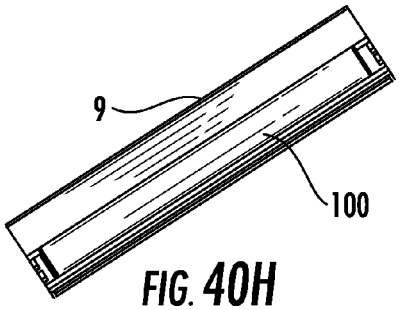

In one embodiment, the tabs 22 on the base 20 are inserted into mating slots 18 on the troffer housing 4 (FIGS. 40*e* and 40*f*). The electrical connectors 44 from the LED lamp 100 are electrically coupled to the source of AC power 11 using wire portions 8*b* (FIG. 40*g*). In a typical installation the electrical wires 8*b* that run from the AC power source are simply spliced to the electrical wires 44 from the LED lamp 100. To facilitate the connection of the wires, the LED lamp 100 may be provided with a tether 80 such as a chain or cord that is connected to the base 20 to the end opposite tabs 22. The tether 80 may be connected to the connector 28. The tether 80 may have a hook 82 or other mechanism that may be temporarily engaged with the housing 4 such as by engaging aperture 27 or other structure such that the LED lamp 100 is suspended from the housing 4 by the tabs 22 and the tether 80 to allow access to wires 8*b*. After the electrical connection is made, the base 20 is then placed flat against the base of the troffer housing 4 and the opposite end of the base 20 is secured to the troffer housing 4 (FIG. 40*h*). The tether 82 may be removed or it may be inserted into the wire way 12. As previously explained, a snap-fit connector 26 may be used that engages the existing aperture 27 in the troffer housing such that the LED lamp 100 may be secured to the housing 4 without using any tools. The retrofit is then complete. The ease of assembling the LED lamp 100 in the existing troffer fixtures allows a fluorescent light to be converted to an LED lamp using the existing troffer housing 4 without extensive reworking of the housing or the use of specialized tools or skills. The replacement may be performed without removing the troffer housing 4 from the ceiling.

While the troffer housing 4 and LED lamp 100 have been described herein as a retrofit of a traditional fluorescent troffer light, the LED lamp 100 and the assembly method described herein may also be used to make new LED based troffer fixtures. An LED lamp 100 as described herein may be manufactured as a complete subassembly and may be attached to a new troffer housing 4 as described to create a new fixture.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

a LED lamp comprising:

a base comprising a substantially planar member having a first side and a second side;

a plurality of LEDs attached to the first side of the base;

a lens mounted to the base, the lens covering the plurality of LEDs;

a power supply comprising a driver being mounted to the second side of the base opposite to the plurality of LEDs, the power supply providing power to the LEDs to illuminate the LEDs; and a first electrical connector for providing power to the power supply;

a troffer housing for mounting the LED lamp comprising:

a wire way comprising a trough defining a recessed interior for receiving the power supply;

a second electrical conductor adapted to be connected to a source of power;

wherein the LED lamp is secured to the troffer housing, the power supply is located in the wire way, the base is removably attached to the housing and covers the trough to enclose the recessed interior of the wire way and the first electrical connector and the second electrical conductor are in the enclosed recessed interior and first electrical connector is connected to the second electrical conductor.

2. The lamp of claim 1 further comprising a ballast located in the wire way.

3. The lamp of claim 1 wherein the base comprises a tab that engages a mating aperture on the troffer housing.

4. The lamp of claim 1 wherein the base comprises a snap-fit connector that secures the base to the troffer housing.

5. The lamp of claim 4 wherein the snap-fit connector comprises a deformable member.

6. The lamp of claim 1 wherein the plurality of LEDs extend for substantially the length of the base.

7. The lamp of claim 1 wherein the plurality of LEDs are removable from the base.

8. The lamp of claim 1 wherein a portion of the base is reflective.

9. The lamp of claim 1 wherein the lens diffuses and mixes light from the plurality of LEDs.

10. The lamp of claim 1 wherein the lens has a semicircular cross-sectional shape.

11. The lamp of claim 1 wherein the lens is connected to a front side of the base.

12. The lamp of claim 11 wherein the lens is connected to the base using a snap-fit connection.

13. The lamp of claim 1 wherein the plurality of LEDs are at approximately the same distance from the surface of the lens over the entire surface area of the lens.

14. A LED lamp comprising:

a base having a first end and a second end opposite to the first end;

a plurality of LEDs attached to a first side of the base;

a lens covering the plurality of LEDs attached to the first side of the base;

a power supply comprising a driver for providing power to the LEDs to illuminate the LEDs supported by the base;

a first electrical connector for providing power to the power supply; and a first mechanical connector at the first end of the base configured to releasably connect the first end of the base to a troffer housing;

a second mechanical connector at the second end configured to releasably connect the second end of the base to a troffer housing;

a tether extendin from the base at the second end.

15. The LED lamp of claim 14 wherein the power supply is attached to a second side of the base.

16. The lamp of claim 14 wherein the base is a substantially planar member.

17. The lamp of claim 14 wherein the base is dimensioned to cover a wire way in the troffer housing.

18. The lamp of claim 14 wherein the second connector comprises a tab that is adapted to engage a mating aperture on the troffer housing, the tab being spaced from the first mechanical connector along a length of the base.

19. The LED lamp of claim 14 wherein the first mechanical connector is a snap-fit connector.

20. The lamp of claim 19 wherein the snap-fit connector comprises a deformable member.

21. The lamp of claim 14 wherein the plurality of LEDs extend for substantially the length of the base.

* * * * *